US006545530B1

(12) United States Patent
Jordan

(10) Patent No.: US 6,545,530 B1
(45) Date of Patent: Apr. 8, 2003

(54) CIRCUIT AND METHOD FOR REDUCING QUIESCENT CURRENT IN A VOLTAGE REFERENCE CIRCUIT

(75) Inventor: Mark G. Jordan, New Boston, NH (US)

(73) Assignee: Linear Technology Corporation, Milpitas, CA (US)

( * ) Notice: Subject to any disclaimer, the term of this patent is extended or adjusted under 35 U.S.C. 154(b) by 0 days.

(21) Appl. No.: 10/010,398

(22) Filed: Dec. 5, 2001

(51) Int. Cl.[7] ..... G05F 1/10

(52) U.S. Cl. ..... 327/540

(58) Field of Search ..... 327/536, 534, 327/535, 537, 538, 540, 541, 543

(56) References Cited

U.S. PATENT DOCUMENTS 5,387,882 A * 2/1995 Schoofs ..... 331/111
5,896,025 A * 4/1999 Yamaguchi et al. ..... 320/134

* cited by examiner

*Primary Examiner*—Jeffrey Zweizig
(74) *Attorney, Agent, or Firm*—Fish & Neave; Mark D. Rowland

(57) ABSTRACT

A voltage reference circuit capable of operating at reduced quiescent currents is described. The voltage reference circuit comprises an output circuit, a timer circuit and a control circuit. When in standby mode, in order to decrease power consumed by the output circuit, current through the output circuit is decreased, allowing the voltage at the output node to fall outside of a desired range. To determine when this event has occurred, the control circuit includes a test circuit that generates a test signal characterized by having a voltage that is correlated with the voltage at the output terminal.

60 Claims, 5 Drawing Sheets

CIRCUIT AND METHOD FOR REDUCING QUIESCENT CURRENT IN A VOLTAGE REFERENCE CIRCUIT

BACKGROUND OF THE INVENTION

This invention relates to voltage reference circuits. More particularly, this invention relates to circuits and methods for reducing the quiescent current in voltage reference circuits.

Many different types of circuits require a voltage reference that is relatively independent of temperature fluctuations. For example, in a switching voltage regulator circuit, the circuit's output voltage is compared with a voltage reference. If the output voltage drops below the voltage reference, the output voltage is increased. Generally, to obtain an output voltage that is largely independent of temperature, the voltage reference must be similarly independent of temperature.

Voltage references must also be unaffected by variations in circuit element characteristics. Even circuit elements in integrated circuits made from the same manufacturing process will vary at least slightly from one another. If a voltage reference is dependent on characteristics of circuit elements that vary from chip to chip, the corresponding voltage references produced by the integrated circuits will not be identical. Circuit designers face the challenge of ensuring that voltage references are not a function of such characteristics.

Circuit designers also face the challenge of decreasing the power consumption of voltage reference circuits. Again, a voltage regulator circuit serves as a good example. It is highly desirable to decrease the power consumption of voltage regulators that are employed in portable electronic battery-operated devices such as cell phones. These devices tend to experience short periods of high power use (i.e., periods during which relatively large currents must be supplied to a load), followed by extended periods of low power use (i.e., "standby" time during which a very small load current flows, but a regulated output voltage must be maintained). If the standby periods far exceed the usage periods, the quiescent current (i.e., the input current that flows into the voltage regulator when the output is unloaded but still in voltage regulation) will determine the effective life of the battery. Accordingly, it is desirable to reduce quiescent current consumption as much as possible to extend battery life.

It is difficult to reduce the quiescent current consumption in prior art voltage reference circuits without affecting their accuracy. FIG. 1 shows a typical prior art voltage reference circuit 10, known as a bandgap reference circuit, whose quiescent current is difficult to reduce without affecting the constancy of the voltage reference produced by the circuit. As shown, the voltage reference circuit 10 comprises an op-amp 12, resistors 14, 16 and 18, and a first and second plurality of diodes 20 and 22. The resistors 14 and 18 are coupled between the output of the op-amp 12 and the non-inverting and inverting terminals of the op-amp 12, respectively. The output of the op-amp 12 constitutes the voltage produced by the voltage reference circuit 10.

The voltage reference circuit 10 draws current through the resistor/diode paths and also through the op-amp 12. Typical values for resistors 14, 16 and 18 are 72.6 kohm, 10 kohm and 72.6 kohm, respectively. These resistor values, along with standard diode voltage drops, result in a voltage reference(Vref) of 1.25 V. Given a typical op-amp used in voltage regulator circuits, the total current consumed by the circuit is 26.6 $\mu$a, 16.6 $\mu$a of which pass through the resistor/diode paths. To decrease this current consumption, the values of resistors 14, 16 and 18 may be increased. However, if these resistors are too large, leakage currents cause the value of Vref to vary unacceptably.

In view of the foregoing, it would be desirable to provide a circuit and method for operating voltage reference circuits at very low quiescent current levels during standby periods. It is also desirable that such voltage circuits produce a voltage that is relatively independent of temperature and process fluctuations.

More generally, it would be desirable to provide a circuit and method for decreasing the current consumption of voltage reference circuits.

SUMMARY OF THE INVENTION

It is therefore an object of the present invention to provide a circuit and method for decreasing the current consumption of voltage reference circuits. It as another object of the present invention to provide a circuit and method for providing a voltage reference that maintains a relatively constant output voltage over a wide range of temperatures and differences in circuit element characteristics that result from process variations.

In accordance with these and other objects of the present invention, a voltage reference circuit capable of operating at reduced quiescent currents is described. The voltage reference circuit comprises an output circuit, a timer circuit and a control circuit. When in standby mode, in order to decrease power consumed by the output circuit, current through the output circuit is decreased, allowing the voltage at an output terminal to fall outside of a desired range. The desired range will depend on design goals that are specific for each circuit that needs a voltage reference. Generally, the desired range will be smaller for circuits that require greater levels of accuracy of a voltage reference.

The control circuit includes a test circuit that generates a test signal characterized by a voltage that emulates changes occurring in the voltage at the output terminal. Specifically, changes in the test signal voltage occur without feedback from the voltage at the output terminal. (This does not imply that the test circuit can not receive feedback from the voltage at the output terminal.) The test circuit comprises circuit elements that correspond to circuit elements in the output circuit, thereby enabling the test circuit to independently generate a voltage that is related to the voltage produced by the output circuit. The test signal voltage changes more rapidly than the voltage at the output terminal, which mitigates the effect of temperature changes on the operation of the voltage reference circuit, as will become apparent from the detailed description.

When the test signal indicates the voltage at the output terminal has fallen outside of the desired range, the control circuit generates a control signal. In response to the assertion of the control signal, the output circuit increases its current draw, thereby changing the voltage at the output terminal such that it falls within the desired range. More particularly, the control signal activates the timer circuit such that the timer circuit generates a timing signal. The output circuit increases its current draw for an amount of time determined by the timing signal, thereby allowing the voltage at the output node to reach the desired range. When this occurs, the current through the output circuit is once again decreased.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

As used herein, a circuit element that performs an action "in response to" or that is "responsive to" a signal means that the signal was at least one of the direct or indirect causes of the action. For example, if a circuit element acts only upon receiving both a first signal and a second signal, the circuit element acts in response to either signal. As an additional example, if a circuit element acts only upon receiving a first signal, which is itself the result of a second signal, the circuit element acts in response to the second signal. (The circuit element also acts in response to the first signal.)

Figure 1:
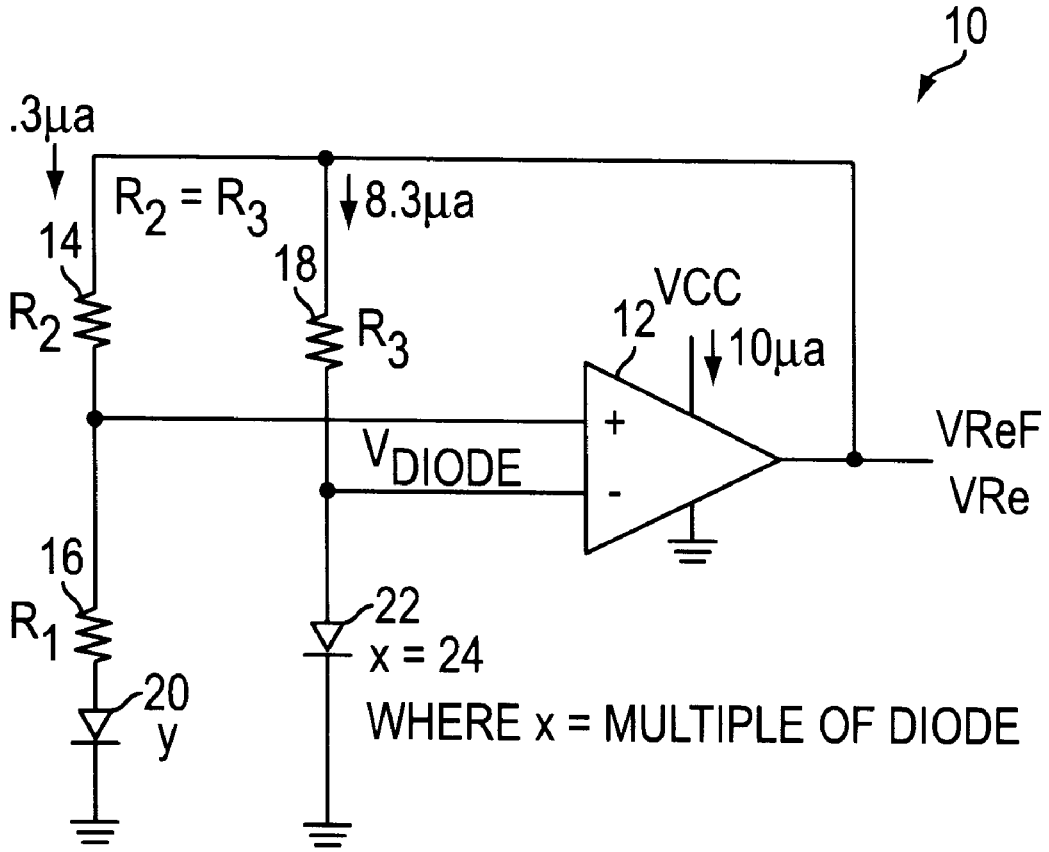
FIG. 1 (PRIOR ART)
FIG. 1 is a schematic diagram of one type of conventional voltage reference circuit.
Figure 2:
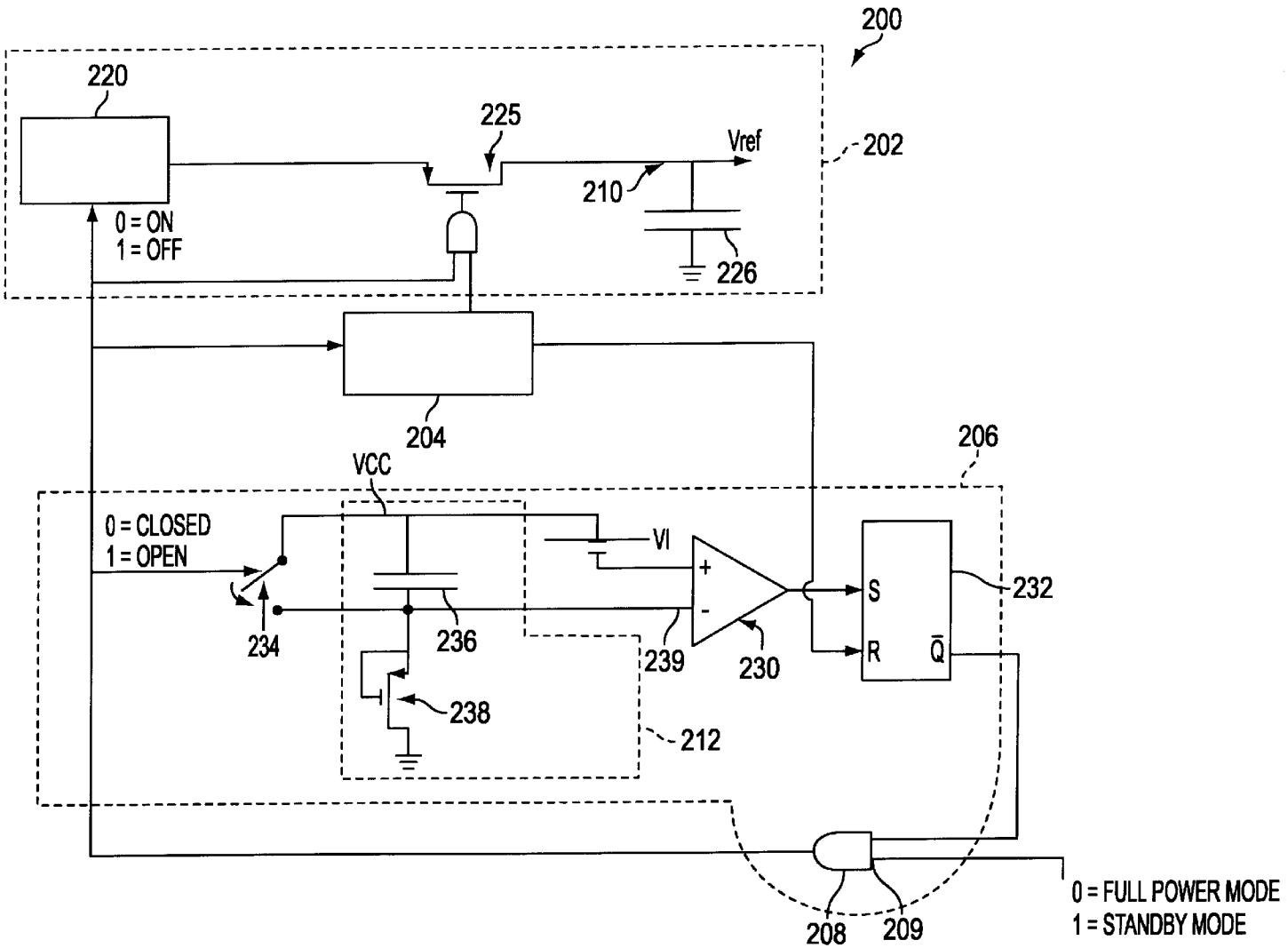
FIG. 2 is a schematic diagram of an exemplary embodiment of a voltage reference circuit constructed in accordance with principles of the present invention.

FIG. 2 shows an embodiment of a voltage reference circuit 200 constructed in accordance with the principles of the present invention. As shown, the voltage reference circuit 200 comprises an output circuit 202, a timer circuit 204 and a control circuit 206. The voltage reference (Vref) is provided at an output terminal 210 of the output circuit 202. The control circuit 206 includes an AND gate 208 that receives a signal through one of its input terminals that places the voltage reference circuit 200 in standby mode. Specifically, if the signal on terminal 209 is high, the voltage reference circuit 200 operates in standby mode.

As will become further apparent from the discussion below, when in standby mode, in order to decrease power consumed by the output circuit 202, the voltage (Vref) at the output terminal 210 may fall outside of a desired range. To detect whether this event has occurred, the control circuit 206 includes a test circuit 212 that generates a test signal whose value is correlated with the voltage at the output terminal 210. When the test signal indicates the value at the output terminal 210 has fallen outside of the desired range, the control circuit 206 generates a control signal. As will be further described below, the output circuit 202 increases its current draw in response to the control signal, thereby changing the voltage at the output terminal 210 such that it falls within the desired range. More particularly, the control signal both directly activates a portion of the output circuit 202 and also activates the timer circuit 204, such that the timer circuit 204 generates a first timing signal in response to the control signal. The output circuit 202 increases its current draw for an amount of time determined by the first timing signal, thereby allowing Vref to reach a value (Vo) within the desired range. The timer circuit 204 is configured such that the first timing signal is of sufficiently long duration to enable Vref to reach Vo. The output circuit 202 comprises a voltage generator circuit 220 that is coupled to a power supply (Vcc) (not shown) and produces a relatively constant voltage at its output when the bandgap reference circuit 220 is activated by the control signal. In the embodiment shown, the voltage generator circuit is a bandgap reference circuit 220 activated when the control signal is asserted low. A capacitor 226 is charged as current flows from the bandgap reference circuit through a switch 225, which is controlled by the first timing signal generated by the timer circuit 204. Voltage generator circuits other than a bandgap reference, including current source circuits having a relatively constant output voltage (such as a zener diode), can be used alternatively to provide charging current to capacitor 226 through switch 225. Vref is the voltage across the capacitor 226. In alternative embodiments, a portion of the voltage at the output terminal may be determined by the voltage across the capacitor. The switch 225 is closed for an amount of time, specified by the first timing signal, sufficient to allow the capacitor 226 to charge up to Vo. The voltage across the capacitor 236 is the value at the output of the bandgap voltage reference circuit 220 less the voltage drop across the switch 225. The switch 225 preferably comprises a PMOS transistor, such that the voltage drop across the switch is equal to the forward biased drop across the PMOS transistor. The gate of the PMOS transistor (switch) 225 receives the first timing signal, which turns the PMOS transistor 225 on and off depending on whether the first timing signal is de-asserted or de-asserted.

The capacitor 226 discharges through the PMOS transistor 225, which acts as a reverse diode since it is turned off. The time course of the capacitor 226 discharge is dictated by the capacitance of the capacitor 226 and the reverse body diode leakage current of PMOS transistor 225.

The control circuit 206 comprises the test circuit 212, a comparator 230, an SR flip flop 232, switch 234 and the AND gate 208. The control circuit 206 also includes a voltage drop V1 coupled in series between a power supply voltage Vcc and the non-inverting input of comparator 230. As previously mentioned, the control circuit 212 generates the control signal when the test signal indicates that Vref has fallen outside of the desired range. In the embodiment shown, the control signal is asserted low when this occurs.

The test circuit 212 comprises circuit elements that match certain characteristics of circuit elements in the output circuit 202, thereby enabling the test circuit 212 to generate a test signal that is related to Vref, regardless of temperature or process variations. Specifically, in the embodiment shown in FIG. 2, the test circuit 212 comprises a capacitor 236, coupled to a power supply (not shown) that produces a power supply voltage Vcc, that is in series with a PMOS transistor 238. (In the preferred embodiment, as will be described with reference to FIG. 5, the PMOS transistor 238 corresponds to a plurality of PMOS transistors, whose total effective reverse body diode leakage is represented in FIG. 2 by the equivalent PMOS transistor 238.) The capacitor 236 and PMOS transistor 238 pair correspond to the capacitor 226 and the PMOS transistor (switch) 225 of the output circuit 202. (In the embodiment shown in FIG. 2, it is assumed that the output terminal 210 is coupled to the gates of MOSFET transistors (not shown), which do not provide a current path to the capacitor 226. If the output terminal 210 is coupled to circuit elements that provide a current path to the capacitor 226, this current path should also be accounted for in the test circuit 212.) When the test circuit 212 is activated, the capacitor 236 charges through the PMOS transistor 238, thereby generating the test signal at an input terminal 239 of the comparator 230.

The de-assertion of the control signal, which means that Vref has the predicted value Vo, also allows the test signal to change from a value Vo=that corresponds to Vo. The correspondence between Vo=and Vo, and the correlation of changes in the control signal with changes of the voltage at the output terminal 210, enables the test signal to serve as a proxy for the voltage at the output terminal 210.

Specifically, the de-assertion of the control signal opens a switch 234. Assuming that the switch 234 has just opened, the voltage at the terminal 239 is Vcc, the power supply voltage. The voltage across the capacitor 236, which is the value of the test signal, is equal to 0 V at this point. This value of the test signal when the control signal has just been de-asserted, 0 V, is the value Vo=mentioned above. The voltage across the capacitor increases from Vo=as current flows from the capacitor 236 through the PMOS transistor 238. When the voltage across the capacitor 236 (i.e. the test signal) just exceeds a voltage V1, a comparator 230, which compares V1 to the voltage across the capacitor 236, is tripped, which in turn causes a flip flop 232 to assert a low value on its $\overline{Q}$ output. This change of the output of the flip flop 232 to a low value constitutes the assertion of the control signal. The assertion of the control signal closes the switch 234, thereby equalizing the voltage across the capacitor 236, preparing it for the next cycle.

The test signal having a value V1 corresponds to a decrease of Vref of X/Y*V1 (from Vo), where Y is the ratio of the capacitances of capacitor 226 to capacitor 236, and X is the ratio of the current through the current paths through which the capacitor 226 and capacitor 236 discharge and charge, respectively. In the embodiment shown in FIG. 2, these current paths comprise the ambient body diode leakages of PMOS transistor 238 and PMOS transistor 225. Given the above equation, if X/Y is less than 1, the test signal changes more rapidly than the voltage at the output terminal 210. Specifically, when the comparator 230 trips, the test signal has changed V1 volts during the time the voltage at the output terminal has changed x/Y*V1 volts.

To mitigate the effect of temperature changes on the operation of the circuit 200, X/Y is preferably less than one. (The optimal value of X/Y will depend on circuit-specific parameters and design goals.) Since the droop in the voltage at terminal 210 (Vdroop=the change in Vref) depends on the value of V1, if V1 is generated by circuit elements that are affected by temperature changes, Vdroop will be altered as well. However, if X/Y is very low, then the effect of changes in V1 will be mitigated. Specifically, since Vdroop is qual to X/Y*V1, d(Vdroop)/d(V1)=X/Y. The change in droop (dvdroop) as a percentage of Vo is d(Vdroop)/Vo*100=(d(V1)*(X/Y)/Vo)*100. As an example, if V1 changes from 1 V to 2 V due to a temperature change, X/Y=0.001, and Vo is equal to 2 V, then the resulting change in the droop as a percentage of Vo is 0.05%.

Viewed in another manner, since the test signal voltage changes more rapidly than the voltage at the output terminal 210, any change in V1 corresponds to a smaller amount of time required by the test signal to make up for the change. Continuing with the above example, if the test signal changes 1000 times more rapidly than Vref, then a change in V1 of x volts corresponds to a change in the amount of time required for the test signal to reach V1 that is 1/1000 of the time that Vref would have to change x volts. Since the amount of time required to reach V1 determines Vdroop, a more rapidly changing test signal results in smaller changes in Vdroop.

Although the test signal voltage changes independently of any changes in Vref, the present invention encompasses circuits that include some type of feedback. For example, feedback from the output terminal 210 might determine whether the test circuit 212 is on or off. Nonetheless, at least at some point in time, changes in the test signal voltage would not be caused by (i.e. are independent of) changes in the voltage at the output terminal 210. In an alternate embodiment of the present invention, an amplifier circuit having an input coupled to the output terminal can be incorporated in the control circuit, in which case the test signal is generated by amplifying the voltage at the output terminal. In yet another alternate embodiment, instead of employing a timer circuitto determine the time required to change the voltage at the output terminal, during the time the output circuit is drawing current, a comparator current having an input coupled to the output terminal and another input coupled to a certain voltage can be incorporated in the control circuit. In this embodiment, the voltage at the output terminal is compared with the certain voltage, in which case current drawn by the output circuit would decrease when the voltage at the output terminal has reached the certain voltage.

Returning to the general operation of the control circuit 206, as previously mentioned, when the test signal indicates Vref has reached an undesired value, a control signal is generated. The control signal (asserted low) activates the bandgap voltage reference circuit 220 and prompts the generation of the first timing signal by the timer circuit 204. In response to the assertion of the first timing signal, the switch 225 turns on until the first timing signal is de-asserted, which is enough time to charge Vref back up to Vo.

Figure 3:
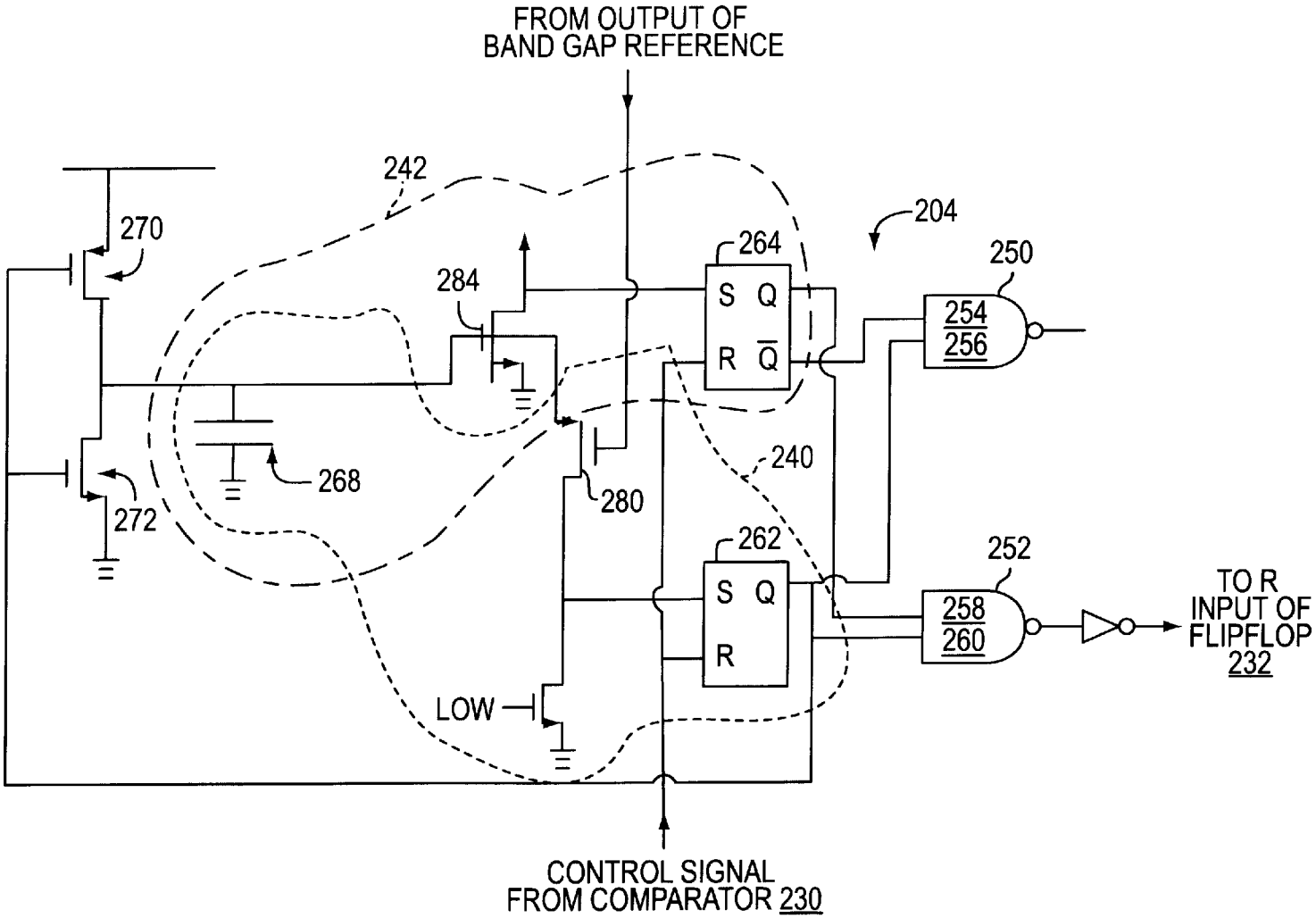
FIG. 3 is a schematic diagram of an exemplary embodiment of a timer circuit comprising a portion of the voltage reference circuit shown in FIG. 1.

FIG. 3 is a diagram of the timer circuit 204 that generates the first timing signal, and a second timing signal that resets the flip flop 232 (FIG. 2). As shown, the timer circuit 204 comprises first and second delay circuits 240 and 242, respectively. Each of the delay circuits 240 and 242 is coupled to a first NAND gate 250 and a second NAND gate 252 with corresponding input terminals 254, 256, 258 and 260. Just before the assertion of the control signal, the voltages at terminals 254 and 256 of the first NAND gate 250 are high and low, respectively, while the voltages at terminals 258 and 260 of the second NAND gate 252 are both low. In response to the control signal, after a certain period of time T1, the first delay circuit 240 changes the voltage at the input terminal 256 of the first NAND gate 250 from a low value to a high value, causing the output of the NAND gate 250 to turn low, which constitutes the generation of the first timing signal. The period T1 is preferably the amount of time required for the bandgap reference circuit 220 to produce a desirable voltage after it has been activated by the assertion of the control signal. If Vref was immediately pulled to the voltage of the bandgap reference circuit 220 upon assertion of the control signal, Vref could have, at least temporarily, a value that varies unacceptably from Vo.

As previously described, in response to the assertion of the first timing signal, switch 225 (FIG. 2) is closed. The first timing signal is de-asserted after a second period of time T2 determined by the second delay circuit 242. T2 is the amount of time required to charge capacitor 226. T2 may be computed given a worst case droop in Vref, the current provided by the bandgap reference circuit 220 and the capacitance of the capacitor 226. The optimal choices for the latter two values will depend on circuit specific constraints and design goals. For use of the voltage reference circuit 200 in a particular voltage regulator circuit, a capacitance of 25 picofarads has been found to produce good results. This value also allows the switch 225 to have a reasonable size. Corresponding T1 and T2 times are approximately 10 microseconds and 5 microseconds, respectively.

Upon expiration of the second period of time T2, the voltage at terminal 254 goes low and the voltage at terminal 258 goes high, which causes the output of the NAND gate 250 to go high and the output of NAND gate 252 to go low. The change of the output of the first NAND gate 250 to a high value constitutes the de-assertion of the first timing signal. The change of the output of the NAND gate 252 to a low value constitutes the generation of the second timing signal, which resets the flip flop 232 (FIG. 2).

The first and second delay circuits 240 and 242 will now be described in more detail. The first delay circuit 240 comprises an SR flip flop 262 whose Q output is coupled to the input terminals 260 and 256, respectively, of the NAND gates 252 and 250 respectively. The second delay circuit 242 comprises an SR flip flop 264 whose Q and $\overline{Q}$ outputs are coupled to the input terminals 258 and 254, respectively, of the NAND gates 252 and 250 respectively.

The first and second delay circuits 240 and 242 each comprise a capacitor 268. The length of the period T1 is a function of the time required to charge the capacitor 268 while the length of the period T2 is function of the time required to discharge the capacitor 268 after it has been charged. When the capacitor 268 charges to a certain value, the flip flop 262 is set. This event corresponds to the expiration of the period T1, and changes the output of the first NAND gate 250 as previously described. Similarly, when the capacitor 268 discharges to a certain value, the flip flop 264 is set. This event corresponds to the expiration of period T2, and changes the output of the NANDs gate 250 and 252, as previously described.

In response to the assertion of the control signal, the flip flops 262 and 264 are each reset, resulting in the initial inputs to the NAND gates 250 and 252 discussed above. In addition, the Q output of the flip flop 262 is coupled to the gates of a PMOS transistor 270 and an NMOS transistor 272. Thus, when the flip flop 262 is reset, the PMOS transistor 270 turns on while the NMOS transistor 272 turns off. When the PMOS transistor 270 turns on, the capacitor 268 charges. The source of a PMOS transistor 280 is coupled to the capacitor 268 while the gate of the PMOS transistor 280 is coupled to the output of the bandgap reference circuit 220 (FIG. 2), which produces a voltage v_ref_out. The PMOS transistor 280 turns on only when the capacitor 268 has charged to a value of v_ref_out+Vgs of the PMOS transistor 280. (V_ref_out reaches a voltage of over 1 v much more quickly than the capacitor 269, thereby avoiding a race condition.) When the PMOS transistor 280 turns on, the drain of the PMOS transistor 280, which is coupled to the S input of the flip flop 262, is pulled high, thereby setting the flip flop 262. In this manner, the delay circuit 240 determines the period T1.

When flip flop 262 is set, the PMOS transistor 270 turns off while the NMOS transistor 272 turns on, allowing the capacitor 268 to discharge. The capacitor 268 is coupled to the gate of an NMOS transistor 284, whose drain is coupled to the S input of the flip flop 264. When the voltage across the capacitor 268 drops to (approximately) the threshold voltage of the NMOS transistor 284, the NMOS transistor 284 turns off, which pulls the voltage at the drain of the NMOS transistor 284 high, which in turn sets the flip flop 264. In this manner, the second delay circuit 242 determines the period T2.

It will be appreciated that the timer circuit 204 comprises bias transistors and other standard elements, such as inverters, that sharpen signals provided to the inputs of flip flops 262 and 264. These items have been omitted from FIG. 3 for the purpose of clarity.

Figure 4:
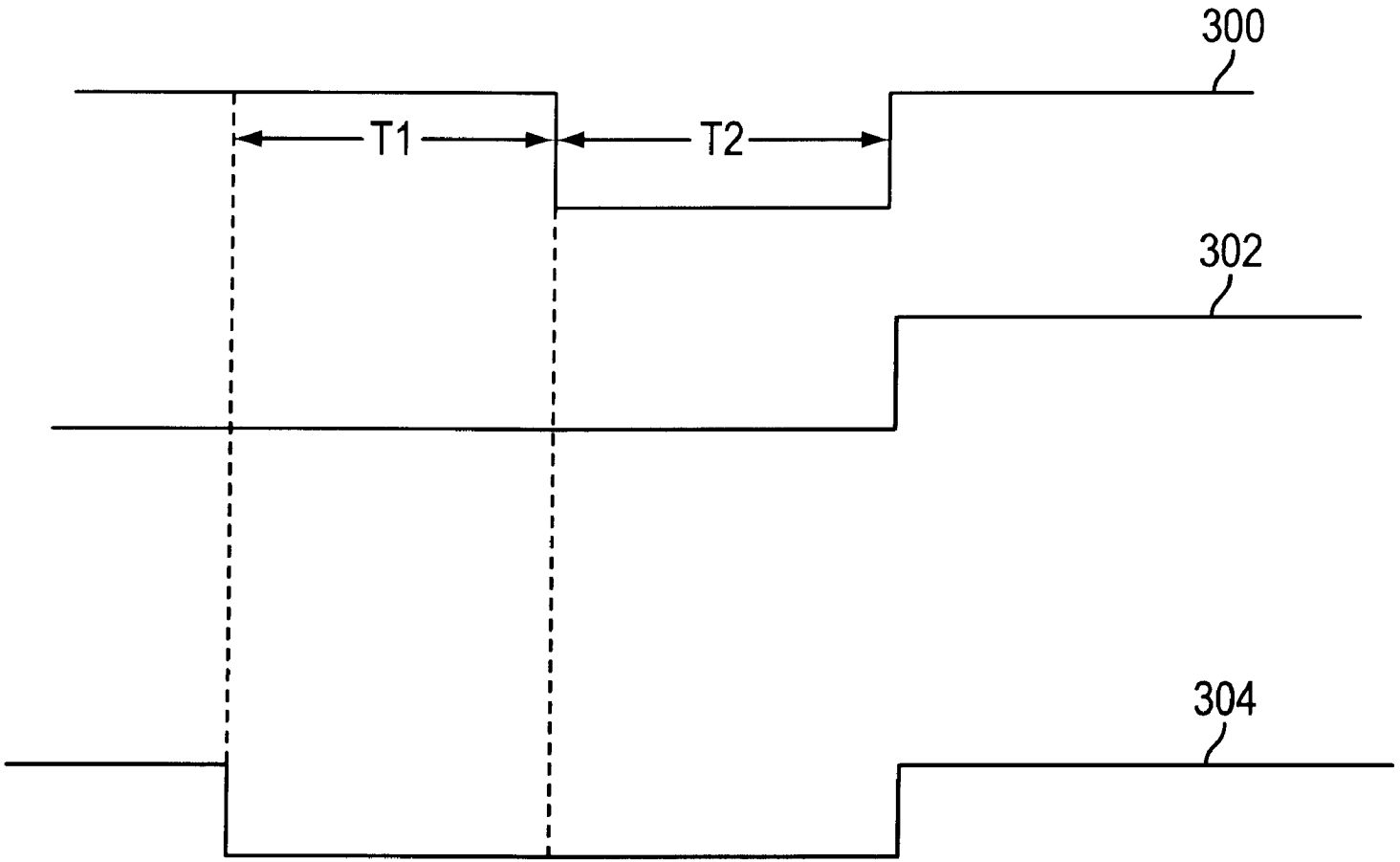
FIG. 4 is a timing diagram for the voltage reference circuit shown in FIG. 1.

FIG. 4 shows the waveforms corresponding to the first and second timing signals and the control signal. Waveform 300 in FIG. 4 shows the assertion and de-assertion of the first timing signal at the output of the first NAND gate 250 while waveform 302 in FIG. 4 shows the assertion and de-assertion of the second timing signal at the output of the second NAND gate 252. Waveform 304 in FIG. 4 shows the assertion and de-assertion of the control signal. As shown in FIG. 4, at the beginning of a cycle (i.e. the assertion of the control signal), after the delay T1 determined in the manner previously described, the first timing signal is asserted when waveform 300 changes from a high value to a low value, turning on the switch 225 (see FIG. 2) as previously mentioned. After the delay T2 determined in the manner previously described, the waveform 300 changes from a low value to a high value, which constitutes the de-assertion of the first timing signal. At this time, waveform 302 also goes high, which causes the flip flop 232 (see FIG. 2) to reset to a high value, which results in a change of the waveform 304 to a high value, which constitutes the deassertion of the control signal. As previously described, in response to the de-assertion of the control signal, the switch 234 closes and the bandgap voltage reference generator 220 turns off (FIG. 2).

Figure 5:
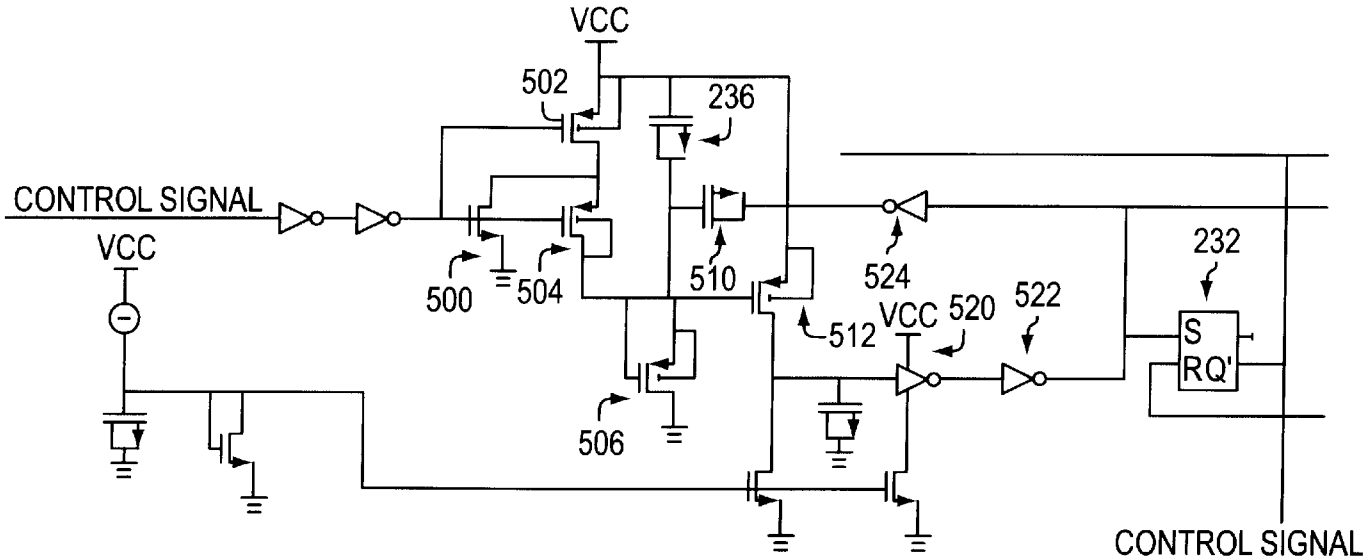
FIG. 5 is a schematic diagram of an exemplary embodiment of a control circuit comprising a portion of the voltage reference circuit shown in FIG. 1.

FIG. 5 is a more detailed circuit diagram of the control circuit 206. PMOS transistors 504 and 506 correspond to the PMOS transistor 238, PMOS transistors 502 and 504 correspond to the switch 234 and PMOS transistor 512 corresponds to the comparator 230. The de-assertion of the control signal, which indicates that Vref has reached its full value Vo and will begin to droop, triggers the generation of the test signal that tracks the voltage droop at the output terminal 210. Specifically, the de-assertion of the control signal means the voltages at the gates of PMOS transistors 502 and 504, and the voltage at the gate of NMOS transistor 500, go high. This pulls the voltage at the source of PMOS transistor 504 low, and turns off PMOS transistors 502 and 504.

At this point, the voltage across the capacitor 236 is 0V. The capacitor 236 begins to charge through the reverse body leakage current through PMOS transistors 504 and 506. The NMOS transistor 500, which is on, provides a current path to ground through the PMOS transistor 504. The voltage across the capacitor 236 begins to rise, which means that the voltage at the gate of the PMOS transistor 512 begins to fall, until it reaches a sufficiently low level to turn on PMOS transistor 512. This event corresponds to the tripping of the comparator 230 (FIG. 2). The voltage at the drain of the PMOS transistor 512 is pulled high, thereby setting the flip flop 232 through a pair of inverters 520 and 522. The setting of flip flop 232 constitutes the generation of the control signal. An inverter 524 and a capacitor 510, which is coupled to the gate of the PMOS transistor 512, provide a positive feedback loop to improve response.

When the control signal is generated, the voltage across the capacitor 236 must be reset in preparation for the next cycle. The assertion of the control signal causes the voltage at the gates of the PMOS transistors 502 and 504 to go low, turning these transistors on, which in turn pulls the voltage at the gate of the PMOS transistor 512 high and drives the voltage across the capacitor 236 to 0 V. The turning on of PMOS transistors 502 and 504 corresponds to the closing of the switch 234 (FIG. 2).

Figure 6:
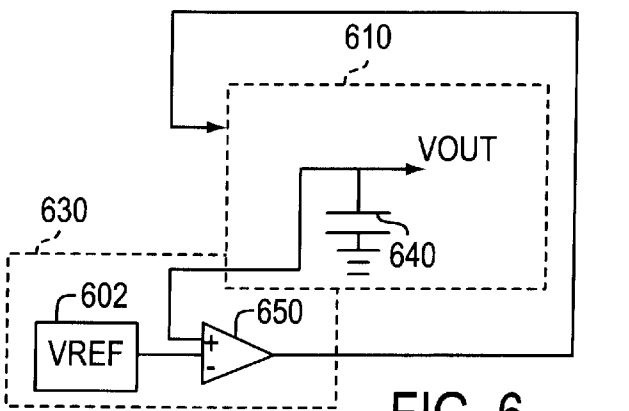
FIG. 6 is a schematic diagram of an exemplary embodiment of a voltage regulator circuit that incorporates a voltage reference circuit constructed in accordance with the principles of the present invention.

FIG. 6 illustrates a switching voltage regulator 600 employing a voltage reference circuit 602 constructed in accordance with the present invention. Voltage regulator 600 generally comprises an output circuit 610 and a control circuit 630.

The output circuit 610 comprises a capacitor 640. The voltage across the capacitor 640 constitutes the output voltage of the voltage regulator 600. When the voltage regulator 600 is put in standby mode, reference circuit 602 also is placed in a standby mode by a signal indicating that the regulator is operating in standby mode, e.g., by a control signal as shown in FIG. 2, thereby reducing its power consumption. In standby mode, voltage regulator 600 allows the voltage across the capacitor 640 to droop until a comparator 650 determines that a feedback signal indicative of the voltage has decreased below a threshold generated by the voltage reference circuit 602. If so, a signal is sent to the output circuit 610 that results in the harging of the capacitor 640.

Thus, a voltage reference circuit capable of reducing quiescent current has been disclosed. Although an example of a possible use of the present invention has been shown, namely in the context of a voltage regulator, it will be appreciated that the present invention may be employed in many other circuits.

It will also be understood that where the circuit is illustrated with PMOS transistors, NMOS transistors may also be employed; and where the circuit uses an NMOS transistor, a PMOS transistor may also be employed. Further, it will be appreciated that the present invention may be implemented with other types of transistors such as bipolar transistors. Indeed, the present invention may be implemented with switching devices other than transistors.

It also will be understood that the terms "asserted" and "de-asserted" are used herein only for convenience, and that no fixed logic levels are intended or should be inferred by their use. For example, a signal may be asserted high or low (and de-asserted in opposite fashion) as desired, without substantially affecting the operation of the invention disclosed herein.

Persons skilled in the art will thus appreciate that the present invention can be practiced by other than the described embodiments, which are presented for purposes of illustration and not of limitation, and that the present invention is limited only by the claims which follow.

What is claimed is:

1. A voltage reference circuit for providing a voltage reference at an output terminal, the voltage reference circuit comprising:

a control circuit that generates a control signal at a first terminal when a test signal indicates the voltage at the output terminal has fallen outside of a desired range, the control circuit comprising a test circuit that generates the test signal, and a comparator circuit coupled to the test circuit, wherein the rate of change of the voltage of the test signal is different than the rate of change of the voltage at the output terminal at least at some point in time;

an output circuit having a terminal coupled to the first terminal of the control circuit, comprising the output terminal and a voltage generator circuit coupled thereto, wherein the output circuit increases its current draw in response to the assertion of the control signal, thereby changing the voltage at the output terminal such that it is within the desired range.

2. The voltage reference circuit of claim 1 wherein the voltage of the test signal changes more rapidly than the voltage at the output terminal.

3. The voltage reference circuit of claim 1 wherein the output circuit comprises a first capacitor and at least a portion of the voltage at the output terminal is determined by the voltage across the first capacitor.

4. The voltage reference circuit of claim 3 wherein the voltage at the output terminal is the voltage across the first capacitor.

5. The voltage reference circuit of claim 1 wherein the ratio of the rate of change of the test signal to the rate of change of the voltage at the output terminal is constant.

6. The voltage reference circuit of claim 5 wherein the test signal is equal to the voltage at a test node that is reset to a first value in response to the assertion of the control signal, and wherein the voltage at the test node is allowed to vary from the first value only after the voltage at the output terminal has reached a second value correlated to the first value.

7. The voltage reference circuit of claim 6 wherein:

the output circuit further comprises a discharge circuit through which the first capacitor discharges;

the test circuit comprises:

a second capacitor and a charge circuit through which the second capacitor charges;

a comparator that compares the voltage across the second capacitor with a predetermined voltage V1; and the control signal is generated by the comparator when the voltage across the second capacitor is greater than V1, such that the control signal is generated when the voltage at the output terminal has changed by an amount equal to V1*X/Y, where Y is the ratio of the capacitances of the first capacitor to the second capacitor, and X is the ratio of charging current through the charge circuit to discharge current through the discharge circuit.

8. The voltage reference circuit of claim 1 wherein the control signal is generated when the test signal indicates that the voltage at the output terminal is below a predetermined value.

9. The voltage reference circuit of claim 1 wherein the output circuit comprises a first switch that closes in response to the assertion of the control signal, thereby allowing the output circuit to increase its current draw.

10. The voltage reference circuit of claim 9 wherein the first switch comprises a PMOS transistor.

11. The voltage reference circuit of claim 9 wherein the increased current drawn by the output circuit flows through the first switch.

12. The voltage reference circuit of claim 9 wherein the output circuit comprises a voltage generator circuit that is coupled to the output terminal through the first switch such that the voltage generator circuit provides current to the output terminal when the first switch is closed.

13. The voltage reference circuit of claim 12 wherein the voltage generator circuit comprises a bandgap voltage reference generator.

14. The voltage reference circuit of claim 12 wherein the output circuit comprises a capacitor, the output voltage is the voltage across the capacitor, and the capacitor is coupled to the voltage generator circuit through the first switch such that the capacitor charges when the first switch is closed.

15. The voltage reference circuit of claim 9 further comprising a timer circuit coupled to the control circuit and the output circuit, wherein the timer circuit generates a first timing signal in response to the assertion of the control signal, and wherein the first switch closes in response to the assertion of the first timing signal.

16. The voltage reference circuit of claim 15 wherein the timer circuit de-asserts the first timing signal after a period of time T2 that commences upon assertion of the first timing signal, and wherein the first switch opens in response to the de-assertion of the first timing signal.

17. The voltage reference circuit of claim 16 wherein the timer circuit comprises a first capacitor, and the period T2 is determined by the amount of time required to discharge the first capacitor.

18. The voltage reference circuit of claim 17 wherein the timer circuit generates the first timing signal after an amount of time T1 that commences upon assertion of the control signal, wherein the length of T1 is determined by the amount of time required to charge the first capacitor to a threshold voltage.

19. The voltage reference circuit of claim 18 wherein the output circuit comprises a second capacitor and a bandgap voltage reference generator coupled to the second capacitor through the first switch, and wherein the threshold voltage depends on the voltage at the output of the bandgap voltage reference generator.

20. The voltage reference circuit of claim 19 wherein the timer circuit generates a second timing signal in response to the assertion of the control signal, and the control circuit de-asserts the control signal in response to the assertion of the second timing signal.

21. A voltage reference circuit for providing a voltage reference at an output terminal, the voltage reference circuit comprising:

a control circuit that generates a control signal at a first terminal when a test signal indicates the voltage at the output terminal has fallen outside of a desired range, the control circuit comprising a test circuit that generates the test signal, and a comparator circuit coupled to the test circuit, wherein at least some changes in the voltage of the test signal are not caused by changes in the voltage at the output terminal;

an output circuit having a terminal coupled to the first terminal of the control circuit, comprising the output terminal and a voltage generator circuit coupled thereto, wherein the output circuit increases its current draw in response to the assertion of the control signal, thereby changing the voltage at the output terminal to a value that it is within the desired range.

22. The voltage reference circuit of claim 21 wherein the rate of change of the voltage of the test signal is different than the rate of change of the voltage at the output terminal.

23. The voltage reference circuit of claim 22 wherein the voltage of the test signal changes more rapidly than the voltage at the output terminal.

24. The voltage reference circuit of claim 22 wherein the output circuit comprises a first capacitor and a first current path, and the test circuit comprises a second capacitor and a second current path, and wherein the ratio of the capacitance of the first capacitor to the second capacitor and the ratio of the currents through the first and second current paths determines the ratio of the rate of change of the test signal voltage to the rate of change of the voltage at the output terminal.

25. A voltage reference circuit for providing a voltage reference at an output terminal, the voltage reference circuit comprising:

a control circuit that generates a control signal indicative that the voltage at the output terminal has fallen outside of a desired range;

a timer circuit coupled to the control circuit, wherein the timer circuit generates a first timing signal in response to the assertion of the control signal; and an output circuit coupled to the control circuit and the timer circuit, wherein the output circuit increases its current draw for an amount of time specified at least in part by the first timing signal, thereby changing the voltage at the output terminal to a value within an desired range.

26. The voltage reference circuit of claim 25 wherein the timer circuit de-asserts the first timing signal after a period of time T2 that commences upon assertion of the first timing signal, and wherein the output circuit decreases its current draw in response to the de-assertion of the first timing signal.

27. The voltage reference circuit of claim 26 wherein the timer circuit comprises a delay circuit that determines the length of the period T2.

28. The voltage reference circuit of claim 27 wherein the delay circuit comprises a capacitor and a current path, and the period T2 is a function of the capacitance of the capacitor and the current through the current path.

29. The voltage reference circuit of claim 25 wherein the timer circuit generates the first timing signal after an amount of time T1 that commences upon assertion of the control signal.

30. The voltage reference circuit of claim 29 wherein the timer circuit comprises a delay circuit that determines the length of the period T1.

31. The voltage reference circuit of claim 30 wherein the delay circuit comprises a capacitor and a current path, and the period T1 is a function of the capacitance of the capacitor and the current through the current path.

32. The voltage reference circuit of claim 25 wherein the period T1 is also a function of feedback from the output circuit.

33. The voltage reference circuit of claim 25 wherein the timer circuit generates a second timing signal in response to the assertion of the control signal, and wherein the control circuit de-asserts the control signal in response to the assertion of the second timing signal.

34. A voltage regulator circuit that:

(1) provides a regulated voltage to an output terminal and (2) is capable of operating in a low quiescent current standby mode, the voltage regulator comprising:

a first output circuit, comprising a capacitor coupled to the output terminal, that generates a feedback signal indicative of the regulated voltage;

a first control circuit that receives said feedback signal, the first control circuit comprising:

a comparator that compares the feedback signal with a reference signal; and a voltage reference circuit that generates the reference signal and provides the reference signal to the comparator, wherein the voltage reference circuit reduces its power consumption when it receives a signal indicating that the regulator is operating in standby mode.

35. The voltage regulator of claim 34 wherein the voltage reference circuit comprises:

a second control circuit that generates a second control signal when a test signal indicates the voltage provided to the comparator has fallen outside of a desired range, the second control circuit comprising a test circuit that generates the test signal, wherein the value of the test signal is at least partially correlated with the voltage provided to the comparator;

a second output circuit coupled to the second control circuit and the output terminal, wherein the second output circuit increases its current draw in response to the assertion of the control signal, thereby changing the voltage at the output terminal to a value that it is within the desired range.

36. The voltage regulator of claim 35 wherein the voltage reference circuit comprises:

a timer circuit coupled to the second control circuit, wherein the timer circuit generates a timing signal in response to the assertion of the second control signal; and an output circuit coupled to the second control circuit and the timer circuit, wherein the output circuit increases its current draw in response to the assertion of the second control signal for an amount of time specified at least in part by the timing signal, thereby changing the voltage provided to the comparator to a value within the desired range.

37. In a voltage reference circuit, a method for providing a voltage at an output terminal, the voltage reference circuit including an output circuit that draws current to change the voltage at the output terminal, the method comprising the steps of:

(a) reducing the current drawn by the output circuit, thereby allowing the voltage at the output terminal to change such that it may fall out of a desired range;

(b) while the voltage at the output terminal is changing, generating a test signal whose voltage changes independently of changes in the voltage at the output terminal at least at some point in time;

(c) when the test signal reaches a certain voltage, generating a control signal indicative that the voltage at the output terminal has fallen outside of the desired range;

(d) responsive to the assertion of the control signal, increasing the current drawn by the output circuit such that the voltage at the output terminal is within the desired range.

38. The method of claim 37 wherein the rate of change of the voltage of the test signal is different than the rate of change of the voltage at the output terminal.

39. The method of claim 38 wherein the voltage of the test signal changes more rapidly than the voltage at the output terminal.

40. Th e method of claim 39 wherein the output circuit comprises a first capacitor and a first current path, and the step of generating the test circuit comprises the step of allowing current to flow between a second capacitor and a second current path, and wherein the ratio of the capacitance of the first capacitor to the second capacitor and the ratio of the currents through the first and second current paths determines the ratio of the rate of change of the test signal voltage to the rate of change of the voltage at the output terminal.

41. In a voltage reference circuit, a method for providing a voltage at an output terminal, the voltage reference circuit including an output circuit that draws current to change the voltage at the output terminal, the method comprising:

(a) reducing the current drawn by the output circuit, thereby allowing the voltage at the output terminal to change such that it may fall out of a desired range;

(b) while the voltage at the output terminal is changing, generating a test signal whose voltage changes at a different rate than the rate of change of the voltage at the output terminal;

(c) when the test signal reaches a certain voltage, generating a control signal indicative that the voltage at the output terminal has fallen outside of the desired range;

(d) responsive to the assertion of the control signal, increasing the current drawn by the output circuit such that the voltage at the output terminal is within the desired range.

42. The method of claim 41 wherein the voltage at the output terminal is the voltage across a first capacitor.

43. The method of claim 41 wherein the ratio of the rate of change of the test signal to the rate of change of the voltage at the output terminal is constant.

44. The method of claim 43 wherein the test signal is equal to the voltage at a test node that is reset to a value $V_o$= in response to the assertion of the control signal, and wherein the voltage at the test node is allowed to vary from $V_o$= only after the voltage at the output terminal has reached a voltage $V_0$.

45. The method of claim 44 wherein:

the first capacitor discharges through a discharge circuit;

the step of generating the test signal comprises the step of charging a second capacitor through a charge circuit;

the step of generating the control signal comprises the step of comparing the voltage across the second capacitor with a predetermined voltage V1, and generating the control signal when the voltage across the second capacitor is greater than V1, such that the control signal is generated when the voltage at the output terminal has changed by an amount equal to V1*X/Y, where Y is the ratio of the capacitances of the first capacitor to the second capacitor, and X is the ratio of charging current through the charge circuit to discharge current through the discharge circuit.

46. The method of claim 41 wherein the control signal is generated when the test signal indicates that the voltage at the output terminal is below a predetermined value.

47. The method of claim 41 wherein the step of increasing the current drawn by the output circuit comprises the step of closing a first switch in response to the assertion of the control signal.

48. The method of claim 47 wherein the first switch comprises a PMOS transistor.

49. The method of claim 47 wherein the increased current drawn by the output circuit flows through the first switch.

50. The method of claim 47 wherein the output circuit further comprises a voltage generator that is coupled to the output terminal through the first switch such that the voltage generator provides current to the output terminal when the first switch is closed.

51. The method of claim 50 wherein the voltage generator comprises a bandgap voltage reference generator.

52. The method of claim 50 wherein the output circuit comprises a capacitor, the output voltage is the voltage across the capacitor, and the capacitor is coupled to the voltage generator through the first switch such that the capacitor charges when the first switch is closed.

53. The method of claim 47 further comprising the step of generating a first timing signal in response to the assertion of the control signal, and wherein the first switch closes in response to the assertion of the first timing signal.

54. The method of claim 53 further comprising the step of de-asserting the first timing signal after a period of time T2 that commences upon assertion of the first timing signal, and wherein the first switch opens in response to the de-assertion of the first timing signal.

55. The method of claim 54 wherein the period T2 is determined by the amount of time required to discharge a first capacitor.

56. The method of claim 55 wherein the step of generating the first timing signal is performed such that the first timing signal is generated after an amount of time T1 that commences upon assertion of the control signal, wherein the length of T1 is determined by the amount of time required to charge the first capacitor to a threshold voltage.

57. The method of claim 56 wherein the output circuit comprises a second capacitor and a bandgap voltage reference generator coupled to the second capacitor through the first switch, and wherein the threshold voltage depends on the voltage at the output of the bandgap voltage reference generator.

58. The method of claim 57 further comprising the steps of generating a second timing signal in response to the assertion of the control signal, and de-asserting the control signal in response to the assertion of the second timing signal.

59. The method of claim 41 wherein the certain voltage reached by the test signal in step (c) changes with changes in the ambient temperature.

60. A voltage reference circuit for providing a voltage at an output terminal, the voltage reference circuit comprising:

a first capacitor coupled to the output terminal;

a first switch coupled to the first capacitor;

a voltage generator coupled to the first capacitor through the first switch;

a second capacitor;

a second switch coupled to the second capacitor;

a comparator coupled to the second capacitor, the comparator having an output characterized by a voltage that depends on the value of a voltage across the second capacitor;

a timer circuit coupled to the comparator and the first and second switches such that the timer circuit asserts a first timing signal in response to a change in the voltage of the comparator output, and a second timing signal related to the first timing signal, wherein the first switch is configured to close in response to the assertion of the first timing signal, thereby charging the first capacitor for an amount of time determined by the first timing signal, the second capacitor is configured to develop across it a voltage correlated to the voltage at the output terminal, and the second switch is configured to close in response to the second timing signal, thereby changing the voltage across the second capacitor.

* * * * *